US005331982A

United States Patent [19]

Machelett

[11] Patent Number: 5,331,982

[45] Date of Patent: Jul. 26, 1994

[54] COSMETICS COMPACT

[75] Inventor: Dietrich Machelett, Meinerzhagen, Fed. Rep. of Germany

[73] Assignee: Wilhelm Koopmann KG, Meinerzhagen, Fed. Rep. of Germany

[21] Appl. No.: 101,816

[22] Filed: Aug. 3, 1993

Related U.S. Application Data

[63] Continuation of Ser. No. 920,038, Jul. 27, 1992, abandoned.

[30] Foreign Application Priority Data

May 11, 1992 [DE] Fed. Rep. of Germany ... 9206291[U]

[51] Int. Cl.[5] ..... A45D 42/02

[52] U.S. Cl. ..... 132/301; 132/294; 132/315; 206/581

[58] Field of Search ..... 132/293, 294, 295, 296, 132/300, 301, 314, 315; 206/1.5, 235, 581, 823; 220/DIG. 26

[56] References Cited

U.S. PATENT DOCUMENTS

| | | | |
|---|---|---|---|
| 1,126,217 | 1/1915 | Hough | 132/301 |
| 2,230,202 | 1/1941 | Machin et al. | 132/315 |
| 4,399,826 | 8/1983 | Ogasawara | 132/301 |
| 4,454,889 | 6/1984 | Contreras, Sr. | 132/301 |
| 4,483,355 | 11/1984 | Yuhara | 132/301 |
| 4,679,576 | 7/1987 | Yuhara et al. | 132/293 |
| 4,681,127 | 7/1987 | Gueret | 132/301 |
| 4,685,558 | 8/1987 | Feliz et al. | 132/294 |
| 4,860,920 | 8/1989 | Quennessen | 206/581 |
| 4,863,034 | 9/1989 | Contreras, Sr. | 206/581 |
| 4,930,528 | 6/1990 | Hatakeyama | 132/293 |

FOREIGN PATENT DOCUMENTS

| | | | |
|---|---|---|---|
| 2137594 | 10/1984 | United Kingdom | 206/823 |
| 2216878 | 10/1989 | United Kingdom | 132/315 |

*Primary Examiner*—Gene Mancene
*Assistant Examiner*—Frank A. LaViola
*Attorney, Agent, or Firm*—Edwin D. Schindler

[57] ABSTRACT

A cosmetics compact having a shell-shaped housing lower part and a lid coupled by way of a hinge, and a presser. The technical problem is to facilitate opening of the lid after unlocking. A pre-tensionable element which bears against the lid and pre-tensions the latter in the direction of opening is arranged on the housing lower part or on an insert thereof, spaced from the hinge axis.

7 Claims, 2 Drawing Sheets

COSMETICS COMPACT

This application is a continuation of application Ser. No. 07/920,038, filed Jul. 27, 1992, now abandoned.

The invention relates to a cosmetics compact having a shell-shaped housing lower part and a lid coupled by way of a hinge, and a presser.

In a cosmetics compact of this type, the lid can be raised after actuating the presser. This raising of the lid which, although unlocked, is still closed, is sometimes laborious.

The object of the invention is to facilitate opening of the lid after unlocking.

This object is achieved in accordance with the invention in that a pre-tensionable element which bears against the lid and pre-tensions the latter in the direction of opening is arranged on the housing lower part or on an insert thereof, spaced from the hinge axis.

The invention differs from the prior art in that the pre-tensionable element provides for partial opening of the lid when the lid is unlocked by the presser. The element can be constructed in different ways and can be arranged at different points, as will be explained in detail below.

A particularly economical construction is achieved in that the element is integrally formed in one piece with the housing lower part.

Another embodiment provides for the element to be integrally formed with a wall of an insert of the housing lower part.

A further embodiment is constructed in that a holder is inserted, with the element, in a recess of a wall of the housing lower part or of the insert.

The arrangement can be kinematically reversed in that a pre-tensionable element which bears against a wall of the housing lower part and pre-tensions the lid in the direction of opening is arranged on the lid or on an insert thereof, spaced from the hinge axis.

A functional element is achieved in that the element is constructed as a resiliently flexible web.

Another embodiment is characterized in that the element is constructed to be bracket-shaped.

An embodiment in which the element is constructed as a tongue is furthermore possible.

Example embodiments of the invention are explained below with reference to the drawings, in which.

Figure 1:
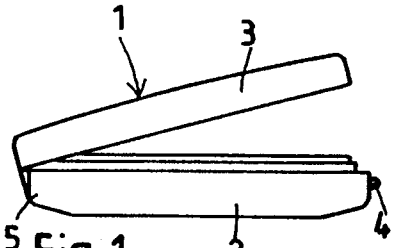
FIG. 1 represents a cosmetics compact in partially opened view.
Figure 2:
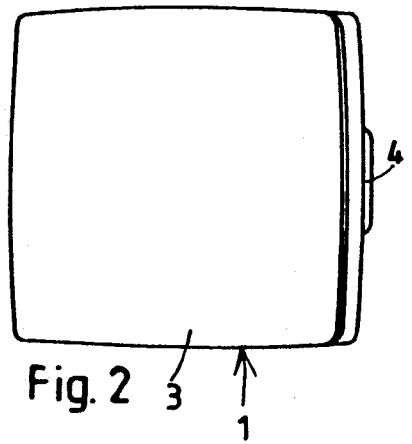
FIG. 2 represents a plan view of FIG. 1.

FIGS. 1 and 2 show diagrammatically a cosmetics compact 1 comprising a shell-shaped housing lower part 2 having a presser 4 and a lid 3. The lid 3 is connected by means of a hinge 5 to the housing lower part. By actuating the presser 4, the lid 3 springs open into the partiality opened position in accordance with FIG. 1. Complete opening of the lid 3 is then possible without further measures.

Figure 3:
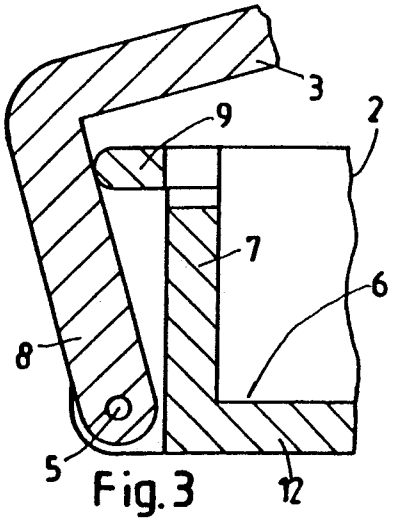
FIG. 3 represents a partial section of a first example embodiment.
Figure 4:
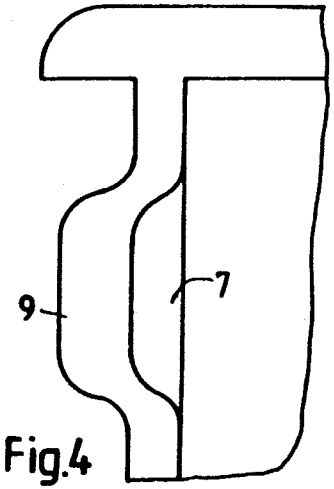
FIG. 4 represents a plan view of the housing lower part.

The housing lower part 2 is of shell-shaped construction and has a receiver 6 for an insert or a powder tray. The hinge 5 holds a hinge strip 8 of the lid firm. In the example embodiment in accordance with FIGS. 3 and 4, a flexible bracket-shaped web 9 is integrally formed on a rear wall 7 of the housing lower part 2. This web 9 is deformed when the cosmetics compact 1 is closed and is thus pre-tensioned. When the presser 4 is actuated, the web 9 recoils resiliently, so that it presses against the hinge strip 8 and thus partially raises the lid 3, as can be seen from FIG. 3. In this partially opened position, it is possible to take hold of the lid 3 and raise it completely without further measures.

Figure 5:
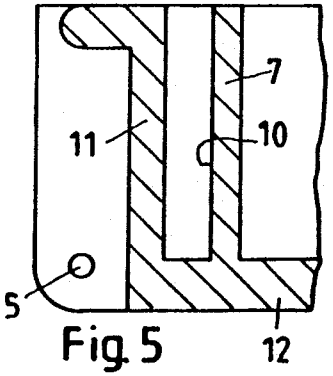
FIG. 5 represents a partial section of a second example embodiment.
Figure 6:
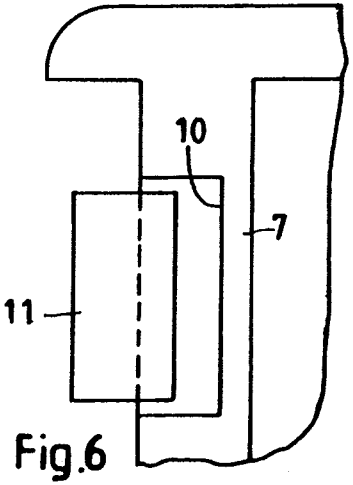
FIG. 6 represents a plan view of FIG. 5.

In the example embodiment in accordance with FIGS. 5 and 6, the rear wall of the housing lower part 2 has a recess 10 in which a flexible web 11 having a bent-off end tongue projects upwards from the baseplate 12 and bears against the hinge strip. Here too, the web 11 is tensioned when the lid 3 is closed, so that it partially raises the lid 3 when the presser 4 is actuated.

Figure 7:
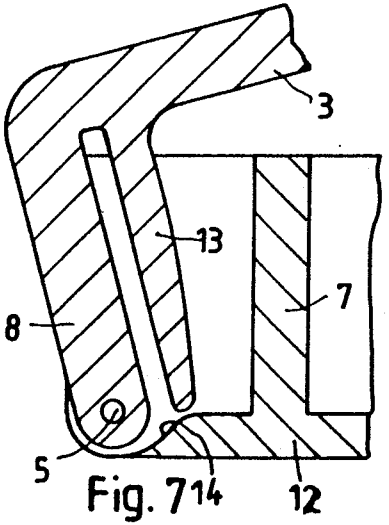
FIG. 7 represents a partial section of a third example embodiment.

The flexible web can also be integrally formed with the lid 3. The example embodiment of FIG. 7 shows a web 13 which runs approximately parallel to the hinge strip 8 and is aligned towards a profiled surface 14 of the baseplate 12. The profiled surface 14 brings about a resilient deformation and tensioning of the web 13 when the lid 3 is closed, so that the web 13 returns to its initial position when the presser 4 is actuated and thus raises the lid 3.

Figure 8:
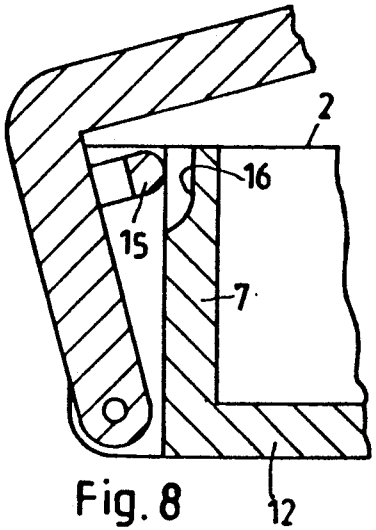
FIG. 8 represents a partial section of a fourth example embodiment.

In the example embodiment in accordance with FIG. 8, the bracket-shaped web 15 is integrally formed with the hinge strip. The rear wall 7 has a hollow 16 in order to improve the deformation conditions. The functioning corresponds to the example embodiment of FIGS. 3 and 4, with the web 15 being mounted on the lid instead of the housing lower part.

Figure 9:
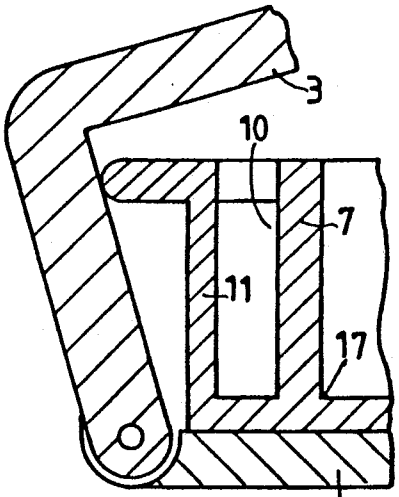
FIG. 9 represents a partial section of a fifth example embodiment.
Figure 10:
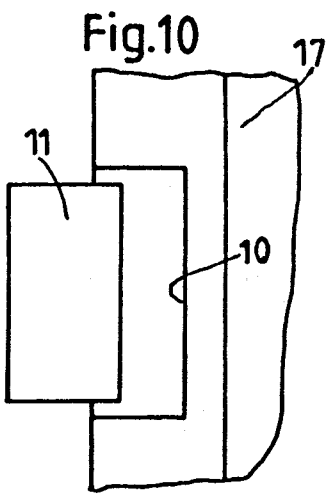
FIG. 10 represents a plan view of the housing lower part with insert.

The example embodiment in accordance with FIGS. 9 and 10 relates to a housing lower part 2 having an insert 17 for receiving the powder tray. A web 11 having an angled-off end tongue is arranged in a recess 10 of the rear wall 7 of the insert 17, so that functioning corresponds to the example embodiment in accordance with FIGS. 5 and 6.

Figure 11:
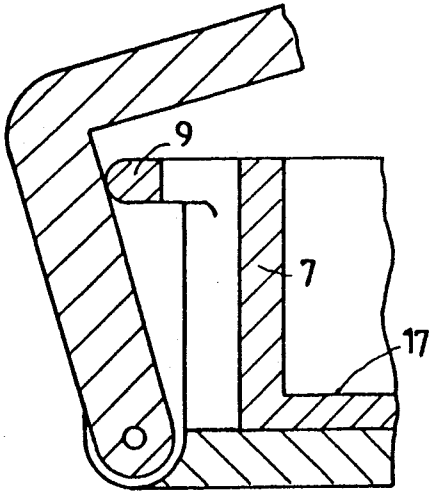
FIG. 11 represents a partial section of a sixth example embodiment.
Figure 13:
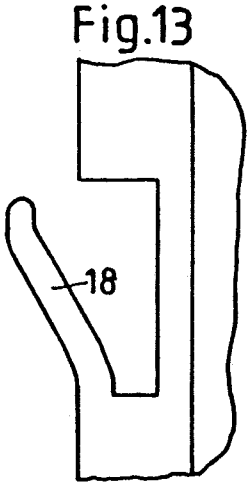
FIG. 13 represents a plan view of a seventh example embodiment.
Figure 12:
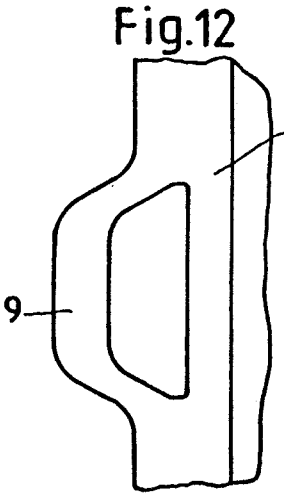
FIG. 12 represents a plan view of the housing lower part with insert.

In the example embodiment in accordance with FIGS. 11 and 12, the web 9 is integrally formed directly on the rear wall 7. The web 9 is constructed to be bracket-shaped. In accordance with FIG. 13, the web 18 can be constructed as a tongue which is tensioned in place at one end.

Figure 14:
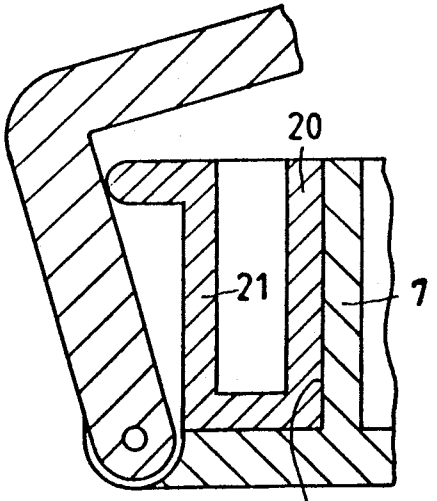
FIG. 14 represents a partial section of an eighth example embodiment.
Figure 15:
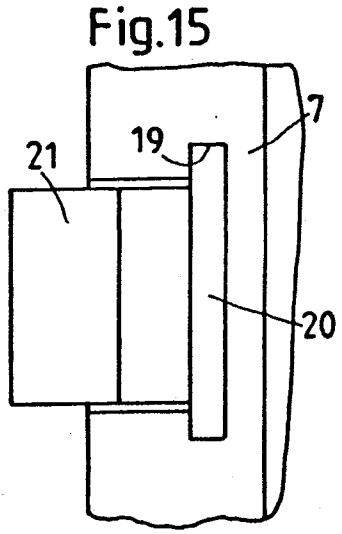
FIG. 15 represents a plan view of the housing lower part.

The example embodiment in accordance with FIGS. 14 and 15 provides, in the rear wall 7 of the housing lower part 2, a receiver guide 19 for a holder 20 having the web 21. The web itself can be constructed in different ways, as described above.

I claim:

1. A cosmetics compact comprising:

a shell-shaped housing lower part and a lid coupled to said housing lower part by a hinge;

a pre-tensioned element;

a presser for opening the lid;

said pre-tensioned element bearing against the hinge and acting to pre-tension said lid in a direction of opening, said pre-tensioned element being integrally formed with a wall of an insert of said housing lower part and being spaced from an axis formed by said hinge;

said pre-tensioned element being a means for partially opening said lid when said lid is unlocked by said presser.

2. The cosmetics compact according to claim 1, further comprising a holder being inserted, with the pre-tensioned element, in a hollow in a wall of said housing lower part.

3. The cosmetics compact according to claim 1, further comprising a holder being inserted, with the pre-tensioned element, in a hollow in said wall of said insert of said housing lower part.

4. A cosmetics compact comprising; a shell-shaped housing lower part and a lid coupled to said housing lower part by a hinge, a pre-tensioned element, and a presser for opening the lid, said pre-tensioned element bearing against a wall of said housing lower part and pre-tensioning said lid in a direction of opening, said pre-tensioned element being integrally formed with a wall of said lid, spaced from a hinge axis, said pre-tensioned element being a means for partially opening said lid when said lid is unlocked by said presser.

5. The cosmetics compact according to claim 4, wherein said pre-tensioned element is constructed as a resiliently flexible web.

6. The cosmetics compact according to claim 5, wherein said flexible web is bracket-shaped.

7. The cosmetics compact according to claim 5, wherein said flexible web is constructed as a tongue.

* * * * *